US011822267B2

(12) United States Patent
Izumichi et al.

(10) Patent No.: US 11,822,267 B2
(45) Date of Patent: Nov. 21, 2023

(54) IMAGE FORMING APPARATUS

(71) Applicant: KYOCERA Document Solutions Inc., Osaka (JP)

(72) Inventors: Sachio Izumichi, Osaka (JP); Akira Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/069,837

(22) Filed: Dec. 21, 2022

(65) Prior Publication Data

US 2023/0195012 A1 Jun. 22, 2023

(30) Foreign Application Priority Data

Dec. 22, 2021 (JP) ..... 2021-207798

(51) Int. Cl.
*G03G 15/20* (2006.01)

(52) U.S. Cl.
CPC ..... *G03G 15/2028* (2013.01)

(58) Field of Classification Search
CPC ..... G03G 15/20; G03G 15/322
USPC ..... 399/107, 114, 322
See application file for complete search history.

(56) References Cited

U.S. PATENT DOCUMENTS 8,078,085 B2 * 12/2011 Okabe ..... G03G 21/1853 399/177

FOREIGN PATENT DOCUMENTS

JP 2017156476 A 9/2017

* cited by examiner

*Primary Examiner* — Hoan H Tran
(74) *Attorney, Agent, or Firm* — Alleman Hall Creasman & Tuttle LLP

(57) ABSTRACT

A guide unit holding portion is formed at a position between two struts in a longitudinal direction of a fixing unit. When a main cover portion rotates from an open position to a closed position, a supported portion of a swing guide unit moves from a position where the supported portion is separated from the guide unit holding portion to a position where the supported portion is in contact with the guide unit holding portion. Further, the supported portion slides on the guide unit holding portion. When the supported portion slides on the guide unit holding portion, the swing guide unit is swung upward, and then held at a target position by the guide unit holding portion.

4 Claims, 6 Drawing Sheets

IMAGE FORMING APPARATUS

INCORPORATION BY REFERENCE

This application is based upon and claims the benefit of priority from the corresponding Japanese Patent Application No. 2021-207798 filed on Dec. 22, 2021, the entire contents of which are incorporated herein by reference.

BACKGROUND

The present disclosure relates to an image forming apparatus including a cover having a guide portion for guiding a sheet.

In an image forming apparatus, a pair of sheet guide portions disposed to face each other form a sheet conveying path.

In addition, one of the pair of sheet guide portions may be provided on a cover capable of opening and closing a part of the main body.

When the cover is opened, the pair of sheet guide portions are separated from each other. Thus, jams in the sheet conveying path can be easily cleared.

SUMMARY

An image forming apparatus according to one aspect of the present disclosure includes a main body frame, a fixing unit, and a main cover portion. The fixing unit includes a fixing member heated by a heater and a pressure member for urging a sheet to the fixing member, and is attached to the main body frame. The main cover portion is rotatably supported. The main body frame includes two struts. The two struts are disposed along a protection side surface which is a side surface forming one end of the fixing unit in a lateral direction, extend in a vertical direction, and are spaced apart from each other in a longitudinal direction of the fixing unit. The main cover portion is supported so as to be rotatable between a closed position to cover the protection side surface of the fixing unit and an open position to expose the protection side surface of the fixing unit. The image forming apparatus further includes a swing guide unit. The swing guide unit includes a post-fixing guide member for guiding the sheet that has passed between the fixing member and the pressure member, and is supported by the main cover portion so as to be swingable up and down. The fixing unit includes a guide unit holding portion. The fixing unit holding portion is formed at a position between the two struts in the longitudinal direction of the fixing unit. The swing guide unit includes a supported portion configured to be brought into contact with the guide unit holding portion. When the main cover portion rotates from the open position to the closed position, the supported portion moves from a position where the supported portion is separated from the guide unit holding portion to a position where the supported portion is in contact with the guide unit holding portion, and the supported portion slides on the guide unit holding portion. When the supported portion slides on the guide unit holding portion, the swing guide unit is swung upward by force received from the guide unit holding portion, and then held at a target position by the guide unit holding portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings. It is noted that the following embodiment is an example of embodying the present disclosure and does not limit the technical scope of the present disclosure.

[Configuration of Image Forming Apparatus 10]

An image forming apparatus 10 according to the embodiment includes a printing device 4 that performs print processing for forming an image on a sheet 9.

The printing device 4 performs the print processing using an electrophotographic method. The sheet 9 is an image forming medium such as paper or a sheet-like resin member.

Figure 1:
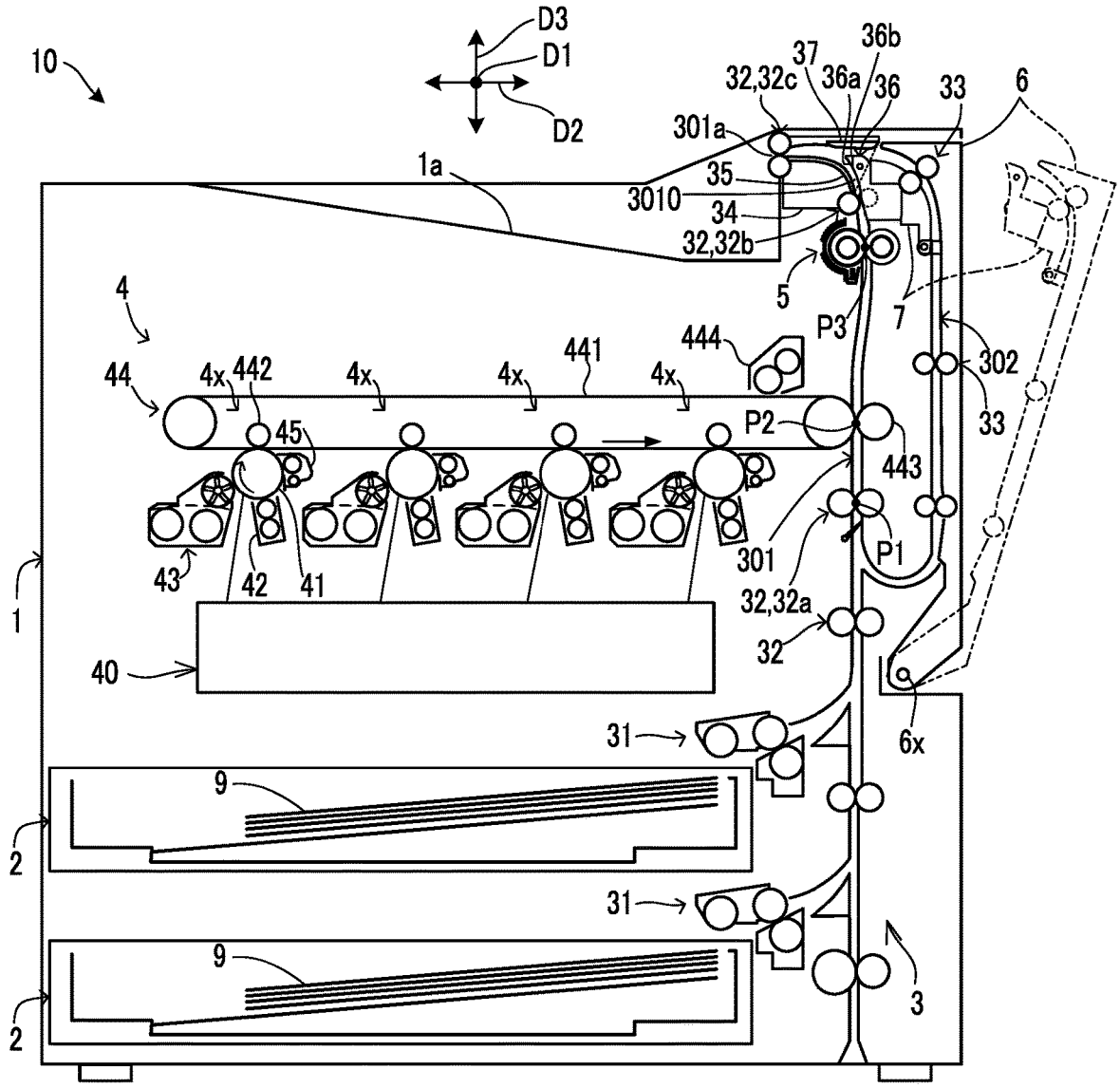
FIG. 1 is a configuration diagram of an image forming apparatus according to an embodiment.

As shown in FIG. 1, the image forming apparatus 10 includes a sheet conveying device 3 and a printing device 4 provided in a main body 1.

Figure 3:
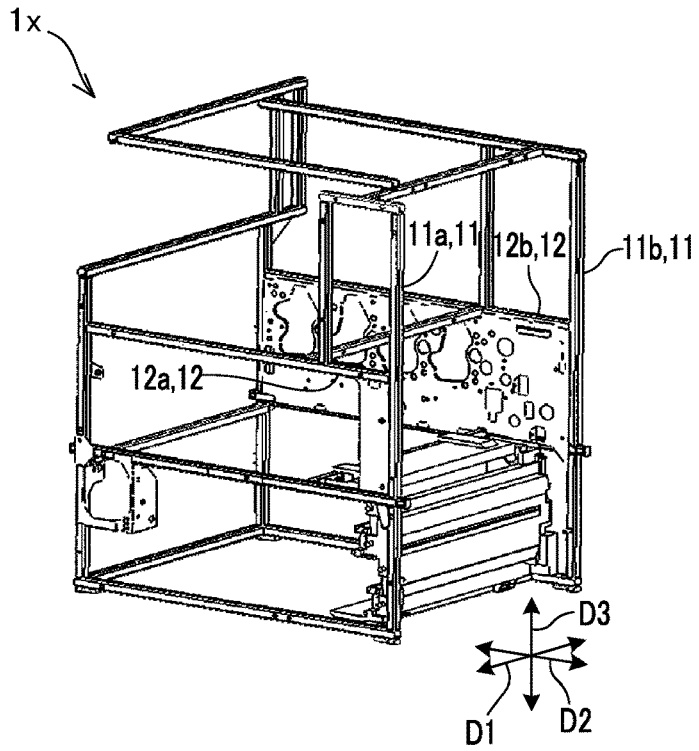
FIG. 3 is a perspective view of a main body frame in the image forming apparatus according to the embodiment.
Figure 5:
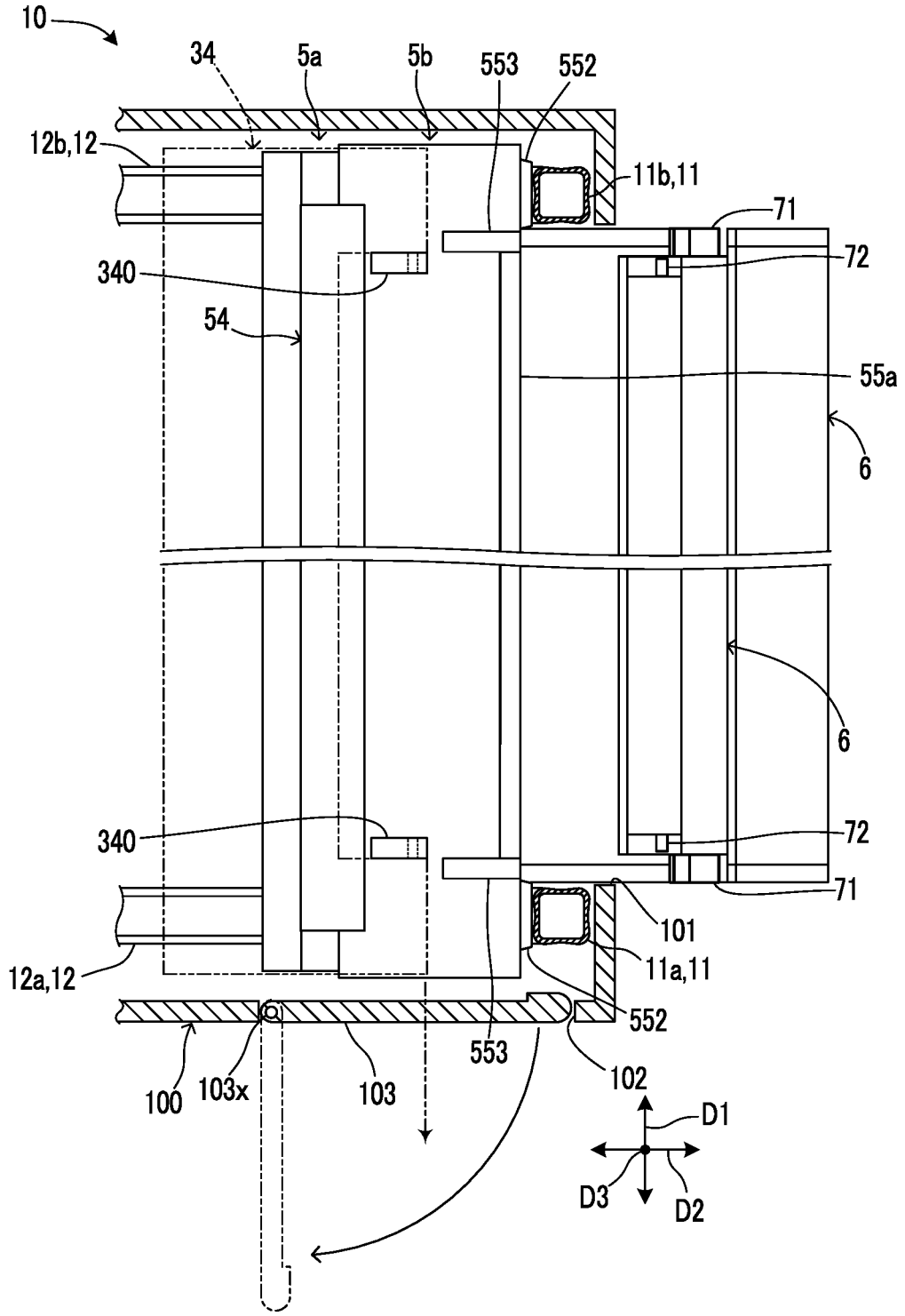
FIG. 5 is a plan view of a peripheral portion of the fixing unit and the swing guide unit in the image forming apparatus according to the embodiment (state where the main cover is open).
Figure 8:
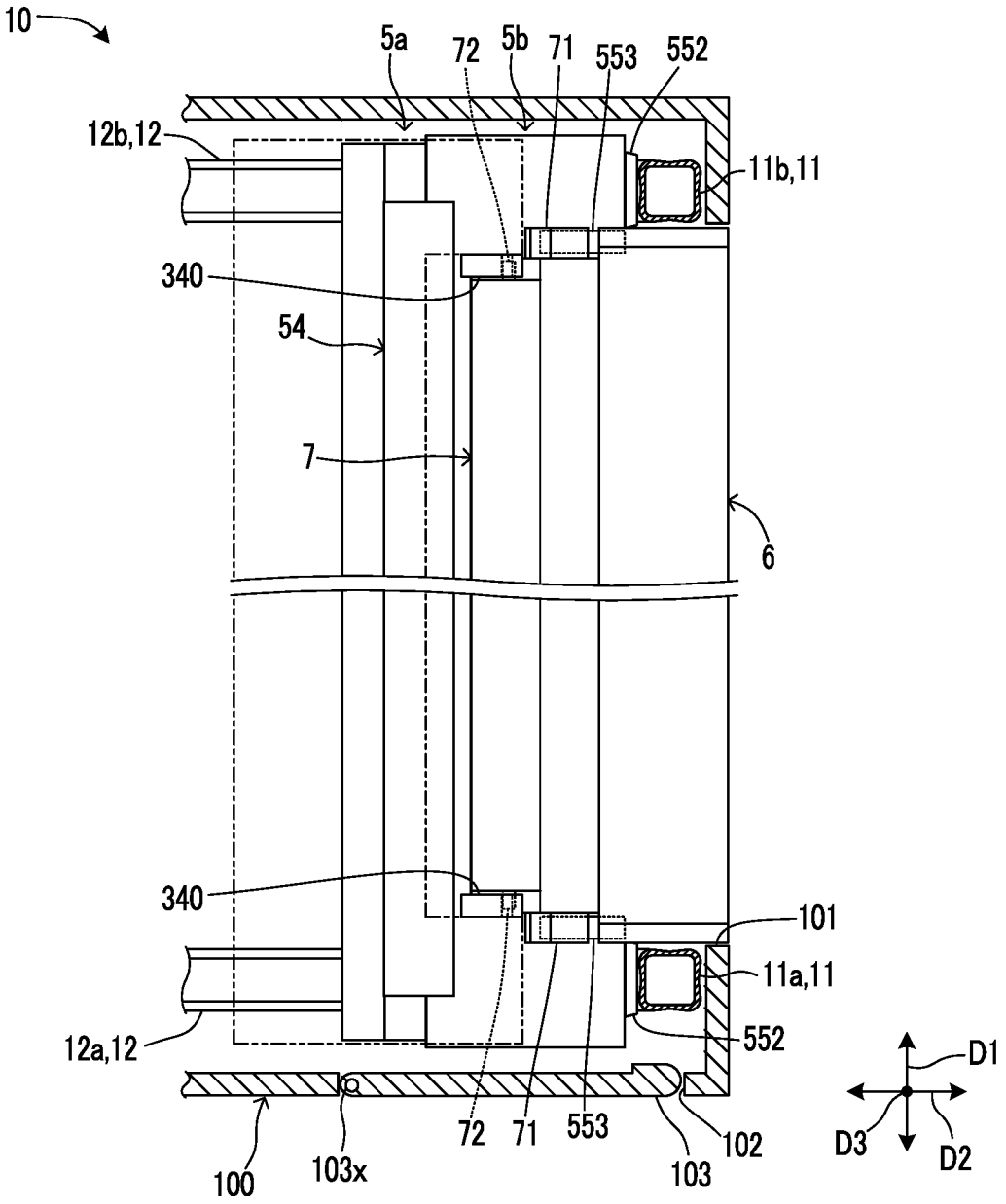
FIG. 8 is a plan view of a peripheral portion of the fixing unit and the swing guide unit in the image forming apparatus according to the embodiment (state where the main cover is closed).

The main body 1 includes a main body frame 1*x* and an exterior member 100 (see FIG. 3, FIG. 5, and FIG. 8). The exterior member 100 is attached to the main body frame 1*x*, and covers the main body frame 1*x*.

The main body frame 1*x* is composed of a combination of a plurality of metal pipes (see FIG. 3). The exterior member 100 is attached to the main body frame 1*x*. The exterior member 100 forms the exterior of the image forming apparatus 10.

The printing device 4 includes one or more image forming portions 4*x*, a laser scanning unit 40, a transfer device 44, and a fixing device 5. The image forming portions 4*x* each include a drum-shaped photoconductor 41, a charging device 42, a developing device 43, a drum cleaning device 45, and the like.

The sheet conveying device 3 includes a feeding device 31, a plurality of main conveying roller pairs 32, and a plurality of sub conveying roller pairs 33. Further, the sheet conveying device 3 includes a drive device (not shown). The drive device drives the feeding device 31, the main conveying roller pairs 32, and the sub conveying roller pairs 33.

The feeding device 31 feeds a sheet 9 stored in a sheet storing portion 2 to a main conveying path 301 in the main body 1. The main conveying path 301 and a sub conveying path 302 to be described later are a passage of the sheet 9.

The main conveying path 301 is a passage from an entrance facing the feeding device 31 to a discharge port 301*a* via a registration position P1, a transfer position P2, and a fixing position P3.

The main conveying roller pairs 32 convey the sheet 9 along the main conveying path 301. The main conveying roller pairs 32 include a registration roller pair 32*a*, a pulling roller pair 32*b*, a discharge roller pair 32*c*, and the like.

In the present embodiment, the transfer position P2 is located above the registration position P1, and the fixing position P3 is located above the transfer position P2. In addition, the discharge port 301*a* is located above the fixing position P3.

The printing device 4 forms a toner image on the sheet 9 conveyed along the main conveying path 301. The toner image is an image using toner as a developer. The toner is granular and is an example of the developer.

The image forming apparatus 10 shown in FIG. 1 is a tandem type color image forming apparatus. Therefore, the printing device 4 includes a plurality of image forming portions 4*x* corresponding to toners of a plurality of colors.

In the present embodiment, the printing device 4 includes four image forming portions 4*x* corresponding to four colors of yellow, cyan, magenta, and black.

In each of the image forming portions 4*x*, the photoconductor 41 rotates, and the charging device 42 charges the surface of the photoconductor 41. Further, the laser scanning unit 40 writes an electrostatic latent image on the surface of the photoconductor 41 by scanning with a light beam.

Furthermore, the developing device 43 supplies the toner to the surface of the photoconductor 41 to develop the electrostatic latent image as the toner image. The photoconductor 41 is an example of an image carrier that rotates while carrying the toner image.

The transfer device 44 transfers the toner image to the sheet 9 at the transfer position P2 of the main conveying path 301. The transfer device 44 includes an intermediate transfer belt 441, four primary transfer devices 442 corresponding to the four image forming portions 4*x*, a secondary transfer device 443, and a belt cleaning device 444.

The primary transfer devices 442 respectively transfer the toner images on the surfaces of the photoconductors 41 to the surface of the intermediate transfer belt 441. Thus, the toner image is formed in color on the surface of the intermediate transfer belt 441.

The secondary transfer device 443 transfers the toner image formed on the intermediate transfer belt 441 to the sheet 9 at the transfer position P2 of the main conveying path 301.

It is noted that, when the image forming apparatus 10 is a monochrome image forming apparatus, the secondary transfer device 443 transfers the toner image on the photoconductor 41 to the sheet 9 at the transfer position P2.

The drum cleaning device 45 removes waste toner remaining on the surface of the photoconductor 41. The belt cleaning device 444 removes waste toner remaining on the intermediate transfer belt 441.

The fixing device 5 heats and presses the toner image on the sheet 9 at the fixing position P3 of the main conveying path 301. Thus, the fixing device 5 fixes the toner image on the sheet 9.

Figure 2:
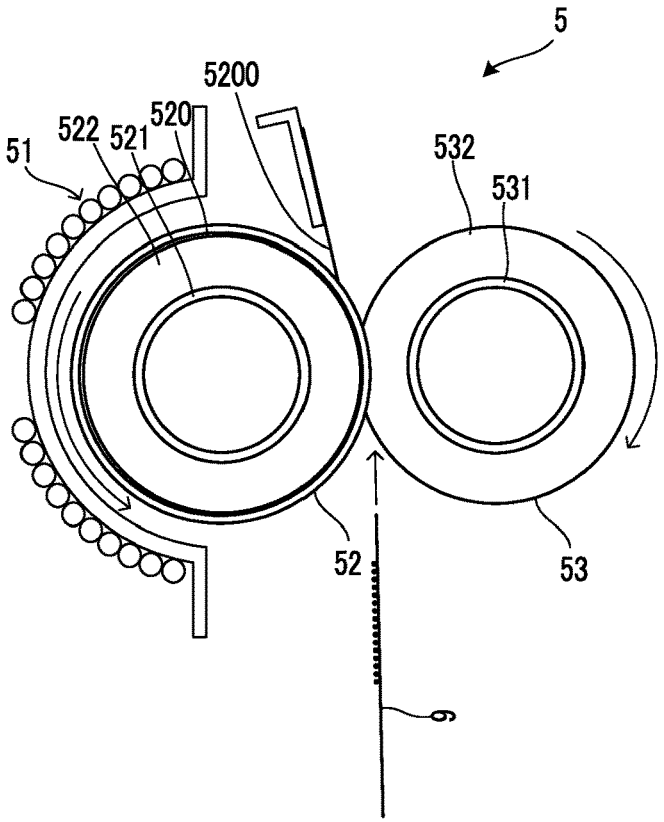
FIG. 2 is a configuration diagram of a fixing device in the image forming apparatus according to the embodiment.

As shown in FIG. 2, the fixing device 5 includes a heater 51, a fixing belt 52, a fixing roller 520, a pressure roller 53, and a sheet separating member 5200.

The fixing belt 52 is a flexible cylindrical member that encloses the fixing roller 520. The fixing belt 52 is heated by the heater 51.

The fixing roller 520 is a cylindrical member that supports the fixing belt 52 inside the fixing belt 52. The fixing roller 520 includes a cylindrical core metal portion 521 and an elastic portion 522 formed on the outer periphery of the core metal portion 521.

The fixing roller 520 is rotatably supported. The fixing belt 52 can rotate together with the fixing roller 520.

The fixing belt 52 includes a conductive base material, an elastic layer formed on the outer periphery of the base material, and a release layer formed on the outer periphery of the elastic layer.

The heater 51 is disposed to face the outer peripheral surface of the fixing belt 52. In the present embodiment, the heater 51 is an electromagnetic induction heating device. The heater 51 mainly heats the base material of the fixing belt 52 by electromagnetic induction.

The pressure roller 53 is rotatably supported. Like the fixing roller 520, the pressure roller 53 also includes a cylindrical core metal portion 531 and an elastic portion 532 formed on the outer periphery of the core metal portion 531.

The pressure roller 53 is rotated by being driven by a drive device (not shown). The fixing belt 52 and the fixing roller 520 rotate in conjunction with the pressure roller 53.

The fixing belt 52 heats the toner image formed on the sheet 9. The pressure roller 53 presses the toner image toward the sheet 9.

It is noted that the fixing belt 52 is an example of a fixing member heated by the heater 51. The pressure roller 53 is an example of a pressure member for urging the sheet 9 to the fixing belt 52.

When the sheet 9 adheres to the fixing belt 52, the sheet separating member 5200 peels the sheet 9 from the fixing belt 52.

The sub conveying path 302 branches off from a portion of the main conveying path 301 between the fixing position P3 and the discharge port 301*a*. In addition, the sub conveying path 302 merges with a portion of the main conveying path 301 on the upstream side of the registration position P1.

The registration roller pair 32*a* is disposed at the registration position P1. The registration roller pair 32*a* temporarily stops the sheet 9 at the registration position P1 and then feeds the sheet 9 to the transfer position P2.

The pulling roller pair 32*b* pulls the sheet 9 that has passed through the fixing position P3 from the fixing device 5 and further conveys the sheet 9 toward the discharge port 301*a*.

The sheet 9 that has passed between the fixing belt 52 and the pressure roller 53 is conveyed to the discharge roller pair 32*c* by the pulling roller pair 32*b*.

The discharge roller pair 32*c* is disposed at the discharge port 301*a*. The discharge roller pair 32*c* rotates in a first rotational direction to discharge the sheet 9 that has passed through the pulling roller pair 32*b* from the discharge port 301*a* to a discharge tray 1*a*.

Meanwhile, the discharge roller pair 32*c* rotates in a second rotational direction to reverse and convey the sheet 9. The discharge roller pair 32*c* conveys the reversed sheet 9 from the main conveying path 301 to the sub conveying path 302.

The sheet conveying device 3 further includes a first sheet guide member 35, a second sheet guide member 36, and a third sheet guide member 37 (see FIG. 1).

The first sheet guide member 35 and the second sheet guide member 36 are disposed to face each other and form a part of the main conveying path 301. The second sheet guide member 36 and the third sheet guide member 37 are disposed to face each other and form a part of the sub conveying path 302.

Figure 4:
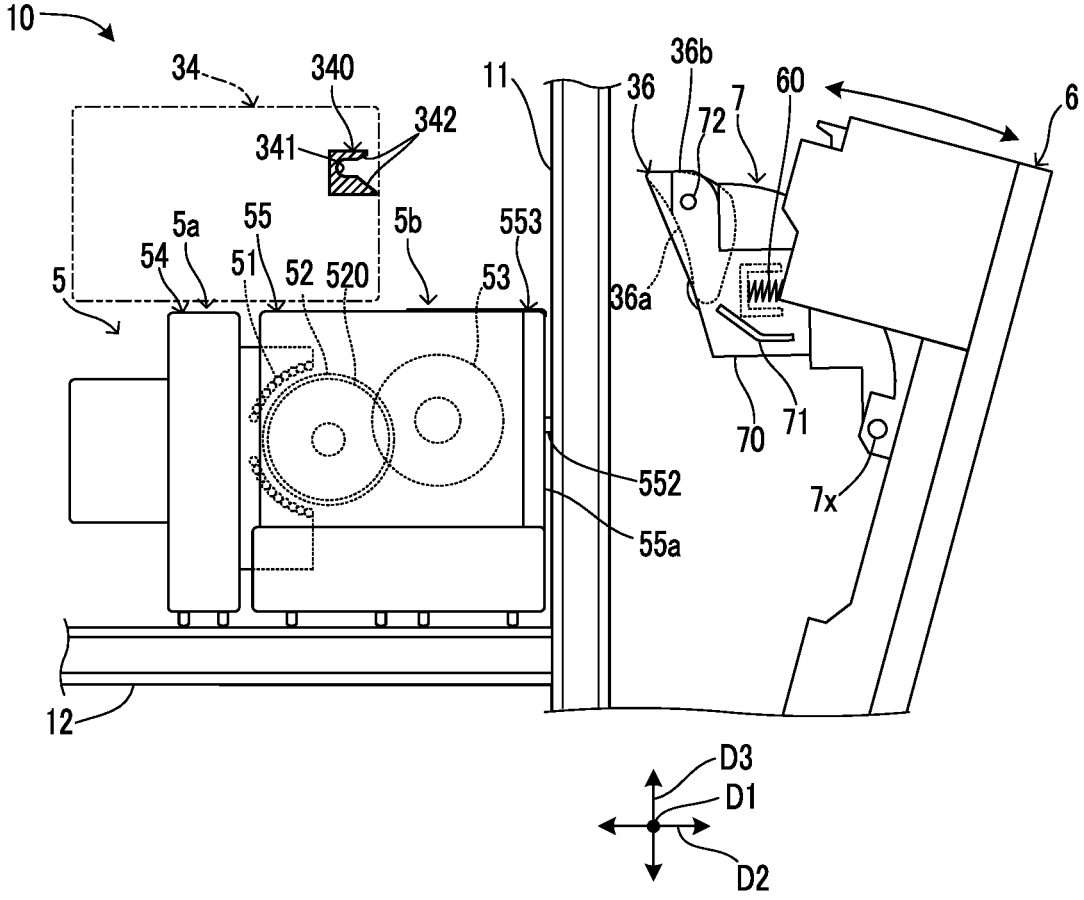
FIG. 4 is a side view of a peripheral portion of a fixing unit and a swing guide unit in the image forming apparatus according to the embodiment (state where a main cover is open).

The surface of the second sheet guide member 36 facing the first sheet guide member 35 is a first guide surface 36*a* (see FIG. 1 and FIG. 4). The surface of the second sheet guide member 36 facing the third sheet guide member 37 is a second guide surface 36*b* (see FIG. 1 and FIG. 4).

In the following description, a portion of the main conveying path 301 from between the fixing belt 52 and the pressure roller 53 to the discharge roller pair 32*c* will be referred to as a rear conveying path 3010. The rear conveying path 3010 is an example of a first conveying path. In addition, the sub conveying path 302 is an example of a second conveying path that branches off from the first conveying path.

The first sheet guide member 35 and the first guide surface 36*a* form a part of the rear conveying path 3010. The first guide surface 36*a* forms a partition wall of a part of the rear conveying path 3010. The first guide surface 36*a* guides the sheet 9 that has passed through the pulling roller pair 32*b* toward the discharge roller pair 32*c*.

The second sheet guide member 36 is an example of a post-fixing guide member for guiding the sheet 9 that has passed between the fixing belt 52 and the pressure roller 53.

The discharge roller pair 32*c* can discharge the sheet 9 guided by the first guide surface 36*a* of the second sheet guide member 36 to the discharge tray 1*a*.

The second guide surface 36*b* and the third sheet guide member 37 form a proximal portion of the sub conveying path 302. The second guide surface 36*b* forms a partition wall of a part of the sub conveying path 302. The second guide surface 36*b* guides the sheet 9 reversed by the discharge roller pair 32*c*, which rotates in the second rotational direction, from the rear conveying path 3010 to the sub conveying path 302.

For example, the discharge roller pair 32*c*, the first sheet guide member 35, and the third sheet guide member 37 are unitized as a discharge unit 34. That is, the discharge unit 34 includes the discharge roller pair 32*c*, the first sheet guide member 35, and the third sheet guide member 37.

The sub conveying roller pairs 33 convey the sheet 9 along the sub conveying path 302. One of the sub conveying roller pairs 33 feeds the sheet 9 from the sub conveying path 302 to the registration position P1 of the main conveying path 301.

When the sheet conveying device 3 conveys the sheet 9 twice along the main conveying path 301 using the sub conveying path 302, the printing device 4 executes double-sided print processing. The double-sided print processing is processing for forming an image on both sides of the sheet 9.

In the present embodiment, the fixing device 5 is divided into a heating unit 5*a* and a fixing unit 5*b* (see FIG. 4 and FIG. 5).

The heating unit 5*a* includes a heater 51 and a first support body 54. The fixing unit 5*b* includes the fixing belt 52, the fixing roller 520, the pressure roller 53, and a second support body 55.

The first support body 54 is a member that supports the heater 51. The second support body 55 is a member that supports the fixing belt 52, the fixing roller 520, and the pressure roller 53. The fixing belt 52 is supported by the second support body 55 via the fixing roller 520.

The heating unit 5*a*, the fixing unit 5*b*, and the discharge unit 34 are attached to the main body frame 1*x*. The fixing unit 5*b* is disposed next to the heating unit 5*a* (see FIG. 4).

The metal pipes constituting the main body frame 1*x* include two struts 11 and two beams 12 (see FIG. 3).

The two struts 11 extend in a vertical direction D3, and are spaced apart from each other in a first direction D1 (see FIG. 3). The vertical direction D3 is an up-down direction. The first direction D1 is a longitudinal direction of the fixing unit 5*b* attached to the main body frame 1*x*.

The two struts 11 extend in the vertical direction D3 beside the fixing unit 5*b* (see FIG. 4 and FIG. 9).

The first direction D1 is also a direction along the rotational center lines of the fixing belt 52 and the pressure roller 53. In the present embodiment, the first direction D1 is the depth direction of the image forming apparatus 10.

The two struts 11 include a first strut 11*a* disposed on the front side of the image forming apparatus 10 and a second strut 11*b* disposed on the rear side of the image forming apparatus 10 (see FIG. 3 and FIG. 5).

The two beams 12 extend in a lateral direction below the heating unit 5*a* and the fixing unit 5*b*, and are spaced apart from each other in the first direction D1 (see FIG. 3 and FIG. 5). The lateral direction is the width direction of the image forming apparatus 10.

The two beams 12 are respectively coupled to the two struts 11 (see FIG. 3). For example, the two beams 12 are respectively coupled to the two struts 11 by welding.

The two beams 12 include a first beam 12*a* disposed on the front side of the image forming apparatus 10 and a second beam 12*b* disposed on the rear side of the image forming apparatus 10 (see FIG. 3 and FIG. 5).

The fixing unit 5*b* is disposed between the heating unit 5*a* and the two struts 11 (see FIG. 4).

The heating unit 5*a* is placed on the two beams 12 in a state of being bridged over the two beams 12. Similarly, the fixing unit 5*b* is placed on the two beams 12 in a state of being bridged over the two beams 12.

The heating unit 5*a* and the fixing unit 5*b* are placed on the two beams 12 with their longitudinal directions aligned with the first direction D1 (see FIG. 5 and FIG. 8).

The exterior member 100 includes a first opening portion 101, a second opening portion 102, a main cover portion 6, and an auxiliary cover portion 103 (see FIG. 1, FIG. 5, and FIG. 8).

The first opening portion 101 is a portion where an opening for exposing a protection side surface 55*a* of the fixing unit 5*b* is formed (see FIG. 5 and FIG. 8). The protection side surface 55*a* is a side surface forming one end of the fixing unit 5*b* in a second direction D2.

The second direction D2 is a lateral direction of the fixing unit 5*b*. The heating unit 5*a* and the fixing unit 5*b* are disposed side by side in the second direction D2. The two struts 11 are disposed along the protection side surface 55*a* (see FIG. 4).

The second opening portion 102 is a portion where an opening for exposing one end of the fixing unit 5*b* in the first direction D1 is formed (see FIG. 5 and FIG. 8).

The main cover portion 6 can open and close the first opening portion 101. For example, the main cover portion 6 is supported by the main body frame 1*x*. In addition, the main cover portion 6 may be supported at an edge of the first opening portion 101 in the exterior member 100.

The main cover portion 6 is supported rotatably around a lower support shaft 6*x* (see FIG. 1). The main cover portion 6 is rotatable between a closed position to cover the protection side surface 55*a* of the fixing unit 5*b* and an open position to expose the protection side surface 55*a*.

One of a pair of partition walls forming the sub conveying path 302 is formed on the inner side surface of the main cover portion 6. Further, a part of the sub conveying roller pairs 33 is disposed on the inner side surface of the main cover portion 6.

When the main cover portion 6 is opened, one of the pair of partition walls forming the sub conveying path 302 is separated from the other. Thus, jams in the sub conveying path 302 can be easily cleared.

In addition, the second sheet guide member 36 is also disposed on the inner surface of the main cover portion 6 (see FIG. 1 and FIG. 4). When the main cover portion 6 is opened, the second sheet guide member 36 is separated from the first sheet guide member 35 and the third sheet guide member 37. Thus, jams in the rear conveying path 3010 can be easily cleared.

The auxiliary cover portion 103 is supported so as to be able to open and close the second opening portion 102 (see FIG. 5). The auxiliary cover portion 103 is supported at an edge of the second opening portion 102 in the exterior member 100. The auxiliary cover portion 103 is supported by a support shaft 103*x*.

The fixing unit 5*b* can be pulled out from the main body frame 1*x* along the first direction D1 by moving the heating unit 5*a* away from the fixing unit 5*b* (see FIG. 5).

When the auxiliary cover portion 103 is open, the fixing unit 5*b* can be pulled out from the main body frame 1*x*. The fixing unit 5*b* is pulled out of the main body 1, from the main body frame 1*x* through the second opening portion 102.

When the cover is closed, the second sheet guide member 36 provided in the main cover portion 6 needs to be properly positioned in the main body 1.

For example, it is conceivable that a guide mechanism for guiding the second sheet guide member 36 provided in the main cover portion 6 to a proper position is provided on the two struts 11 of the main body frame 1*x*.

Meanwhile, in order to reduce the size of the image forming apparatus 10, there is a case where the two struts 11 of the main body frame 1*x* are disposed at a relatively small interval. In this case, it is difficult to secure a space for providing the guide mechanism on the two struts 11.

The image forming apparatus 10 has a configuration for guiding the second sheet guide member 36 provided on the main cover portion 6 to a proper position even when the two struts 11 are disposed at a relatively small interval. Hereinafter, the configuration will be described.

The image forming apparatus 10 includes a swing guide unit 7 attached to the main cover portion 6 (see FIG. 1 and FIG. 4 to FIG. 8). The swing guide unit 7 includes the second sheet guide member 36 and a unit support body 70.

The unit support body 70 supports the second sheet guide member 36. The unit support body 70 is supported by the main cover portion 6. The unit support body 70 is supported so as to be rotatable up and down around a lower support shaft 7*x* (see FIG. 4 and FIG. 6).

The fixing unit 5*b* includes two strut contact portions 552 and one or more guide unit holding portions 553 (see FIG. 4 to FIG. 8). The two strut contact portions 552 face side surfaces of the two struts 11.

The two strut contact portions 552 come into contact with the side surfaces of the two struts 11, respectively. The fixing unit 5*b* is positioned in the second direction D2 by being sandwiched between the heating unit 5*a* and the two struts 11.

The guide unit holding portion 553 is formed at a position between the two struts in the first direction D1.

The guide unit holding portion 553 is a portion extending from an upper corner portion of the fixing unit 5*b* on the protection side surface 55*a* side to the upper surface of the fixing unit 5*b*. The guide unit holding portion 553 is a part of the second support body 55 in the fixing unit 5*b*.

In the present embodiment, two guide unit holding portions 553 are formed at two positions spaced apart from each other in the first direction D1 (see FIG. 5 and FIG. 8).

Figure 6:
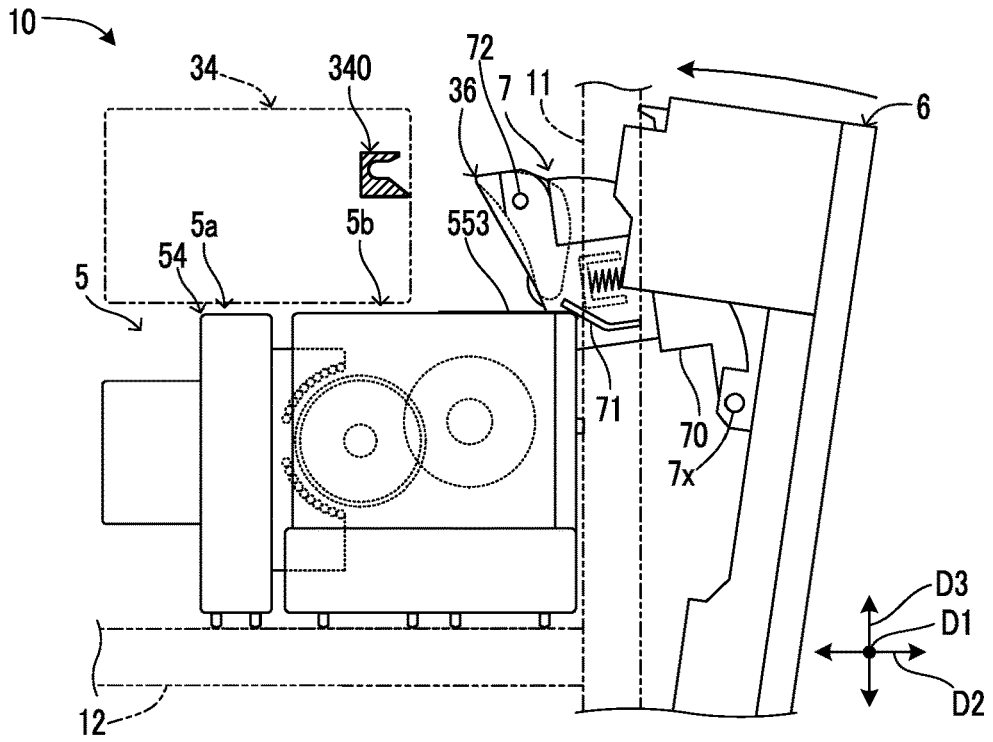
FIG. 6 is a side view of a peripheral portion of the fixing unit and the swing guide unit in the image forming apparatus according to the embodiment (state where the main cover is being closed).

The guide unit holding portion 553 comes into contact with the swing guide unit 7 when the main cover portion 6 rotates from the open position to the closed position (see FIG. 6). Thus, the guide unit holding portion 553 holds the swing guide unit 7 at a target position. For convenience, the strut 11 and the beam 12 are shown by phantom lines (dash-dot-dot-dash lines) in FIG. 6.

Figure 7:
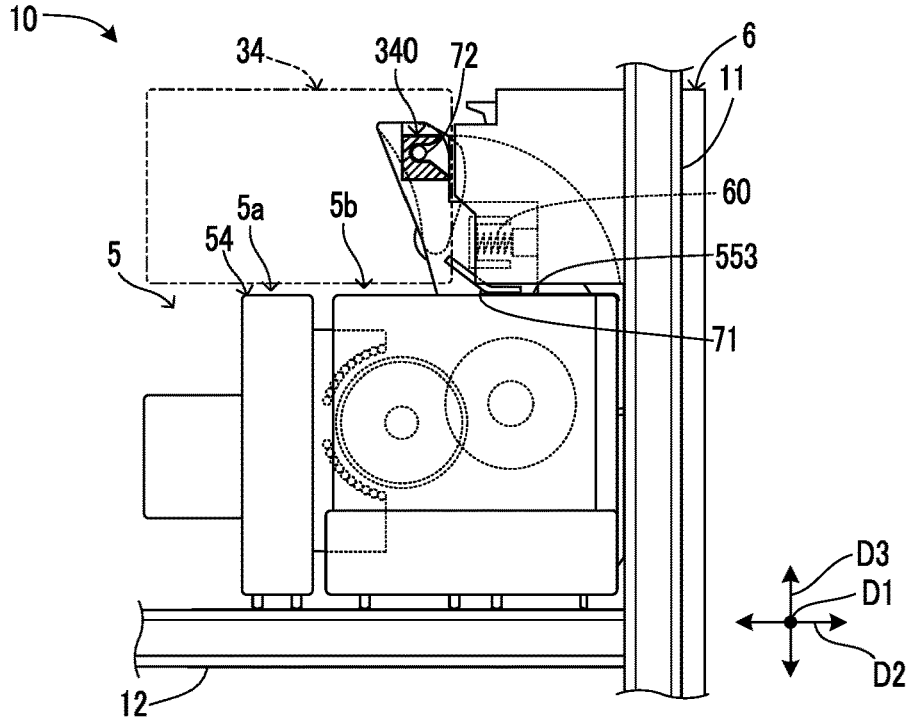
FIG. 7 is a side view of a peripheral portion of the fixing unit and the swing guide unit in the image forming apparatus according to the embodiment (state where the main cover is closed).

FIG. 7 shows a state where the main cover portion 6 is closed and the swing guide unit 7 is held at the target position by the guide unit holding portion 553.

The swing guide unit 7 includes a supported portion 71 which can contact the guide unit holding portion 553. The supported portion 71 is a part of the unit support body 70.

In the present embodiment, the swing guide unit 7 includes two supported portions 71 corresponding to the two guide unit holding portions 553 (see FIG. 5 and FIG. 8).

Hereinafter, the movement of the swing guide unit 7 when the main cover portion 6 rotates from the open position to the closed position will be described.

When the main cover portion 6 rotates to the closed position, the supported portion 71 moves from a position where the supported portion 71 is separated from the guide unit holding portion 553 to a position where the supported portion 71 is in contact with the guide unit holding portion 553 (see FIG. 4 and FIG. 6). Further, the supported portion 71 slides on the guide unit holding portion 553.

When the supported portion 71 slides on the guide unit holding portion 553, the swing guide unit 7 swings upward due to force received from the guide unit holding portion 553. After swinging upward, the swing guide unit 7 is held at the target position by the guide unit holding portion 553 (see FIG. 7).

In addition, in the present embodiment, the discharge unit 34 has a concave first fitting portion 340 that opens laterally (see FIG. 4 to FIG. 8). On the other hand, the unit support body 70 has a convex second fitting portion 72 (see FIG. 4 to FIG. 8).

The first fitting portion 340 and the second fitting portion 72 are formed at a position between the two struts 11 in the first direction D1 (see FIG. 5 and FIG. 8).

In the present embodiment, the first fitting portion 340 is formed at two positions spaced apart in the first direction D1 (see FIG. 5 and FIG. 8). The swing guide unit 7 has two second fitting portions 72 corresponding to the two first fitting portions 340.

The first fitting portion 340 has a recess 341 that opens laterally and a tapered surface 342 continuous with the edge of the recess 341 (see FIG. 4).

When the main cover portion 6 rotates from the open position to the closed position, the second fitting portion 72 fits into the recess 341 of the first fitting portion 340 (see FIG. 7 and FIG. 8). The tapered surface 342 guides the first fitting portion 340 into the recess 341.

By the second fitting portion 72 fitting into the first fitting portion 340, the movement of the swing guide unit 7 in the vertical direction D3 and a closing direction is restricted. The closing direction is a direction from the main cover portion 6 to the discharge unit 34. As a result, the swing guide unit 7 is held at the target position also in the second direction D2.

In the present embodiment, the image forming apparatus 10 includes a spring 60 supported by the swing guide unit 7 or the main cover portion 6 (see FIG. 4 and FIG. 7). The spring 60 urges the swing guide unit 7 toward the discharge unit 34 when the main cover portion 6 is in the closed position (see FIG. 7).

The spring 60 urges the swing guide unit 7 toward the discharge unit 34 to maintain the fitted state of the first fitting portion 340 and the second fitting portion 72.

It is noted that the swing guide unit 7 may have the first fitting portion 340 and the discharge unit 34 may have the second fitting portion 72.

Employing the image forming apparatus 10 makes it possible to realize a mechanism for guiding the second sheet guide member 36 to a proper target position even when the two struts 11 are disposed at a relatively small interval.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a main body frame;

a fixing unit including a fixing member heated by a heater and a pressure member for urging a sheet to the fixing member, and attached to the main body frame; and a main cover portion rotatably supported, wherein the main body frame includes two struts disposed along a protection side surface which is a side surface forming one end of the fixing unit in a lateral direction, extending in a vertical direction, and spaced apart from each other in a longitudinal direction of the fixing unit, the main cover portion is supported so as to be rotatable between a closed position to cover the protection side surface of the fixing unit and an open position to expose the protection side surface of the fixing unit, the image forming apparatus further includes a swing guide unit including a post-fixing guide member for guiding the sheet that has passed between the fixing member and the pressure member and supported by the main cover portion so as to be swingable up and down, the fixing unit includes a guide unit holding portion formed at a position between the two struts in the longitudinal direction of the fixing unit, the swing guide unit includes a supported portion configured to be brought into contact with the guide unit holding portion, when the main cover portion rotates from the open position to the closed position, the supported portion moves from a position where the supported portion is separated from the guide unit holding portion to a position where the supported portion is in contact with the guide unit holding portion, and the supported portion slides on the guide unit holding portion, and when the supported portion slides on the guide unit holding portion, the swing guide unit is swung upward by force received from the guide unit holding portion, and then held at a target position by the guide unit holding portion.

2. The image forming apparatus according to claim 1, further comprising:

a discharge unit including a discharge roller pair capable of discharging the sheet that has passed between the fixing member and the pressure member to a discharge tray, and attached to the main body frame, wherein one of the discharge unit and the swing guide unit includes a concave first fitting portion that opens laterally, another one of the discharge unit and the swing guide unit includes a convex second fitting portion which fits into the first fitting portion when the main cover portion rotates from the open position to the closed position, the first fitting portion and the second fitting portion are formed at a position between the two struts in the longitudinal direction of the fixing unit, and movement of the swing guide unit in the vertical direction and a direction from the main cover portion toward the discharge unit is restricted by the second fitting portion fitting into the first fitting portion.

3. The image forming apparatus according to claim 2, comprising:

a first conveying path which is a conveying path of the sheet extending from between the fixing member and the pressure member to the discharge roller pair; and a second conveying path that branches off from the first conveying path, wherein the post-fixing guide member includes:

a first guide surface forming a partition wall of a part of the first conveying path; and a second guide surface formed on a back of the first guide surface and forming a partition wall of a part of the second conveying path.

4. The image forming apparatus according to claim 1, further comprising:

an exterior member covering the main body frame, wherein the exterior member includes:

an opening portion that exposes one end of the fixing unit in the longitudinal direction; and an auxiliary cover portion capable of opening and closing the opening portion, and the fixing unit is allowed to be pulled out from the main body frame through the opening portion along the longitudinal direction of the fixing unit.

* * * * *